United States Patent [19]

Pech

[11] Patent Number: 4,949,451

[45] Date of Patent: Aug. 21, 1990

[54] DEVICE FOR PLUGGING CONTACTS INTO A CONNECTOR BOX

[75] Inventor: Guy Pech, Labastide St-Pierre, France

[73] Assignee: LABINAL, societe anonyme, France

[21] Appl. No.: 263,886

[22] Filed: Oct. 28, 1988

[30] Foreign Application Priority Data

Oct. 28, 1987 [FR] France ..... 87 14935

[51] Int. Cl.[5] ..... H01R 43/00

[52] U.S. Cl. ..... 29/564.1; 29/742; 29/747

[58] Field of Search ..... 29/33 M, 564, 564.1, 29/564.2, 742, 745, 747, 748, 753, 761, 564.4

[56] References Cited

U.S. PATENT DOCUMENTS

| | | | |
|---|---|---|---|
| 4,190,890 | 2/1980 | Marx | 29/748 |
| 4,563,812 | 1/1986 | Goddard-Watts | 29/747 |
| 4,598,469 | 7/1986 | Weixel | 29/747 |
| 4,658,503 | 4/1987 | Eaton | 29/854 |
| 4,763,411 | 8/1988 | Takeshita | 29/748 |
| 4,803,778 | 2/1989 | Cross | 29/747 |

*Primary Examiner*—Daniel Howell

*Attorney, Agent, or Firm*—Larson and Taylor

[57] ABSTRACT

For the purpose of inserting contacts (80) in a connector box (52), the device comprises an insertion head capable of gripping each contact (80) and final insertion means. The end of the insertion head oriented toward the connector box (52) is beveled for gradually moving apart, during its movement toward this box, the cables and contacts which may have already been mounted.

21 Claims, 6 Drawing Sheets

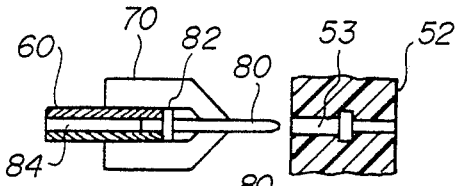
Fig. 7a
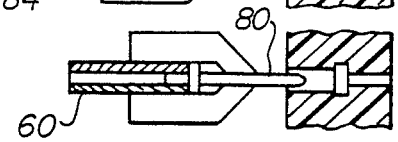
Fig. 7b
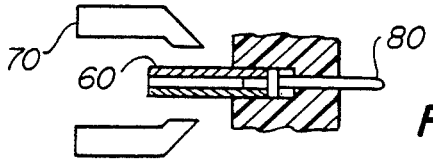
Fig. 7c
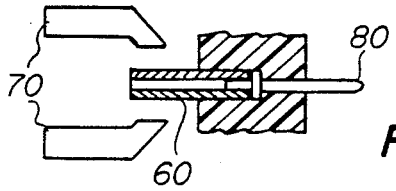
Fig. 7d
Fig. 8
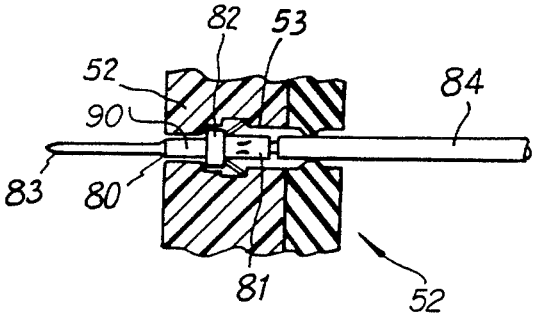

DEVICE FOR PLUGGING CONTACTS INTO A CONNECTOR BOX

The present invention relates to a device for automatically plugging contacts each provided with their individual cable or conductor into a connector box.

The bundles of conductor cables, such as for example avionic bundles, comprise a large number of individual flexible conductors terminating in a contact element or pin disposed in a cavity of a connector box. These boxes therefore have a large number of cavities each receiving such a contact. At the present time, the plugging in of contacts, each connected to the end of its corresponding individual flexible cable or conductor usually by a setting operation, is effected manually, means for aiding and guiding the insertion being provided for facilitating the location and the placing in position of the contacts in the cavities.

These manual plugging or inserting methods are fastidious, costly, and constitute a source of error, it being required that the operator make no mistake not only when identifying the conductors and the cavities but also when effecting the actual insertion.

An object of the present invention is to overcome these drawbacks and to provide a method for inserting contacts provided with their individual cables in cavities of a connector box comprising a large number of cavities in an automatic, rapid, simple, reliable and economical manner.

Another object of the invention is to provide a device which is such as to permit the insertion with no risk of deterioration of the contacts or the flexible conductors connected to the contacts.

Another object of the invention is to permit and facilitate the automatic insertion in a connector box notwithstanding the presence, when inserting the last contacts, of a large mass of cables behind the box, even in respect of very miniaturized connectors.

Another object of the invention is to facilitate, and even render automatic, the identification of a contact and of a cavity which must receive the latter.

A further object of the invention is to permit carrying out in an automatic manner a plurality of operations which must essentially be carried out before the insertion proper, and in particular the correct sectioning of the end of the cable, the baring of the end of the cable and the fixing or setting of this end of the cable in the contact part or socket which must receive it.

The invention provides a device for inserting contacts, each provided with their individual flexible conductor or cable, in the cavities of a connector box, said device comprising a connector box support, insertion means movable in a path, toward and away from the connector box, and means for effecting a relative displacement between the connector support and the path so as to present the desired cavity of the connector box in said path, wherein said insertion means comprise:

an insertion head which is openable for receiving a contact extended by its individual cable and reclosable around the contact, the end of the head oriented toward the connector box being beveled so as to gradually spread apart during its movement toward the connector box the cables of the contacts which may have been already mounted, said insertion head being movable between a withdrawn position for receiving the contact and an advanced position close to the cavity located in said path, and final insertion means, such as a nib, for shifting the contact along the end of the path between the contact position corresponding to said advanced position of the insertion head and an end of insertion position of the contact in the cavity.

The beveled shape of the end of the head is intended to mean a faired or bevelled which gradually tapers toward the front end, such as for example a conical shape, so as to gradually spread apart with no risk of deterioration the cables or conductors of the already-mounted contacts which might be located in the path of the insertion head.

In a preferred embodiment, the front end of the contact emerges, throughout the travel of the insertion head, or at least during the end part of this travel, beyond the front faired or bevelled end of the insertion head so as to already partly penetrate the cavity when the insertion head is immobilized in its advanced position close to the cavity. The means for shifting the contact along the end of the path are then limited to pursuing the penetration of the contact in the cavity which guides the contact to the position of the end of the insertion.

In a particular embodiment of the invention, the insertion head may directly maintain the contact up to the moment it reaches its advanced position, after which the contact is taken over by the final insertion means.

It is in this way possible to employ final insertion means, for example a nib or quill, which mainly exerts a thrust on the contact without having to rigidly maintain or pinch the contact.

In another embodiment, the contact may be positively maintained by said final insertion means which permits shifting the contact along the end of the path. In this case, the insertion head mainly ensures the protection, and possibly a guiding, of the contact during all or a part of the movement of the contact, under the effect of the final insertion means along the end of the path.

This movement along the end of the path under the effect of said final insertion means for the contact may be obtained either by firmly maintaining the rear end of the connector by said means for moving it, or by simply exerting a thrust by said means on a rear bearing surface of the contact such as a flange, or even merely driving the flexible cable at the rear of the contact, and it is then possible to provide a guide channel in the insertion head for guiding and containing the cable in a position close to the rectilinear position so as to constrain it to urge the contact forwardly into the cavity.

The final insertion means for shifting the contact along the end of the path may comprise a nib separable into two semi-nibs so as to open and close around the rear end of the contact and/or the end of the flexible cable or conductor of the contact, then to again open, said nib ensuring either a rigid maintenance of the contact or merely a thrust on a suitable rear projection of the contact such as a flange, the front end of the nib entering with the contact an initial part of the cavity for guiding the contact. As a modification, the nib may merely serve to guide with a small clearance the flexible cable and particular means are provided at the rear for gripping the cable and urging it forwardly.

The driving means which drive the insertion head and/or the final insertion means such as a nib for shifting the contact along the end of the path, are preferably arranged to permit high speeds and low speeds.

In a preferred embodiment of the invention, these driving means ensure first of all, starting at the initial position in which the insertion head takes hold of the contact, a high speed of displacement then, when it reaches the vicinity of the advanced position close to the cavity, the speed becomes slower, means being then responsive to the speed of displacement or to the force exerted on the insertion head to stop the movement if the resistance encountered exceeds a threshold adapted to the foreseen mere resistance offered by the presence of the cables of the already-mounted contacts.

In the preferred case in which the front end of the contact has partly entered the cavity when the insertion head has arrived at its final advanced position close to the cavity, the final insertion means, such as the nib, are then shifted first of all rapidly to a position close to the position of the end of the insertion owing to the fact that no obstacle can be present in this region, then beyond the aforementioned position, the advance occurring slowly and means detecting the resistance to the advance or the end of the movement, stop the movement when the contact has reached its position of the end of the insertion, beyond which it can no longer advance.

Advantageously, the device may further comprise a test gripping device which, as soon as the contact has been definitively inserted, comes to grip a portion of the cable of this contact for exerting a rearward pull. In the case where this rearward movement is possible, which corresponds to an absence of insertion, or to a bad insertion of the contact, or a breakage of the connection between the contact and its cable, this defect can be consequently detected.

The device according to the invention may, in a preferred embodiment, incorporate other stations such as a setting station, a stripping station and a conductive cable sectioning station.

Advantageously, the device may comprise checking means such as in particular a stripping check, for example by the searching of a four-point electric continuity, and/or a visual check of the setting or crimping by means of a camera and/or a checking of the setting by an attempt to extract the cable.

The means for permitting a relative displacement between the connector support and the path so as to present the desired cavity of the connector means in the path, may advantageously be driven by software or any other control programming associating with a given contact the cavity which must correspond thereto. For example; there may be provided for this purpose a desk with a keyboard enabling an operator who identifies the contact by its conductive cable, to effect the entry of an identification code which causes, in accordance with said program, the displacement of said means for bringing the corresponding cavity into the path of insertion.

In another embodiment, in which the contacts or the corresponding cables have marking capable of being read by a data entry apparatus, such as for example labels with an optical marking, for example by a bar code, it is possible to control the carrying out of the program by a direct automatic data entry, the operator then performing only a simple function of supervising the machine which is automatically fed with contacts and wires, means being then provided for assigning to each wire section the corresponding code.

Further features and advantages of the invention will be apparent from the following description given by way of a non-limitative example with reference to the accompanying drawing in which.

Figure 1:
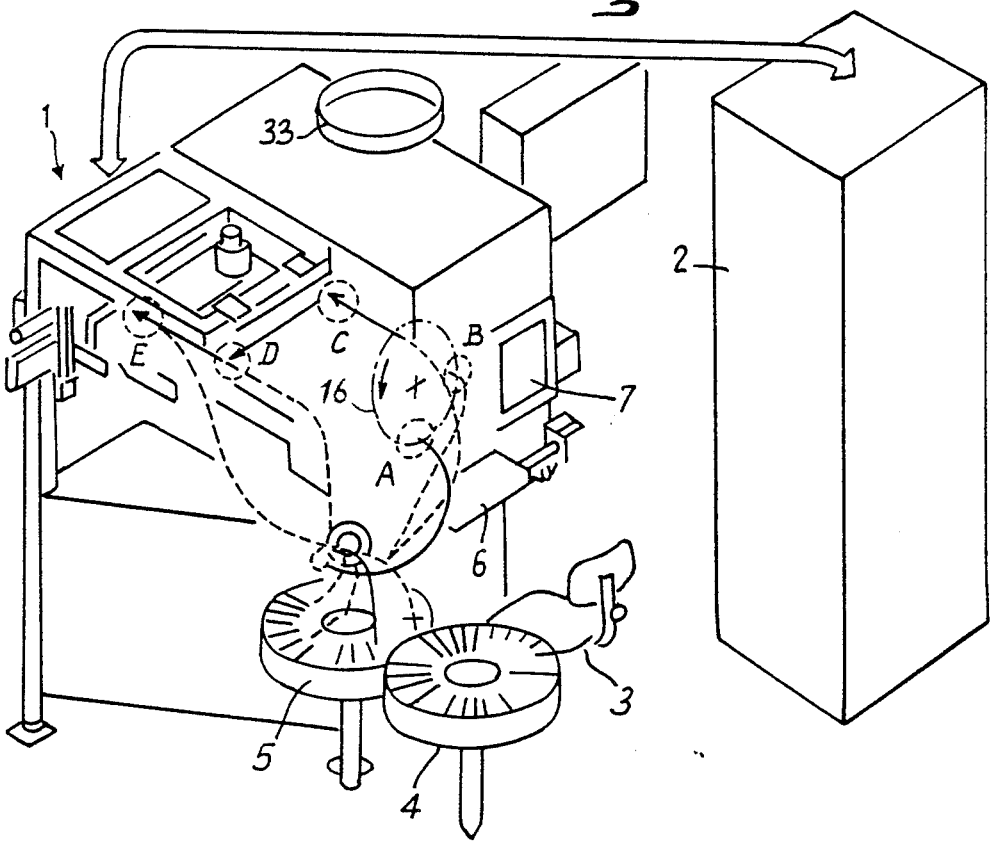
FIG. 1 is a diagrammatic view in perspective of a device according to the invention.
Figure 2:
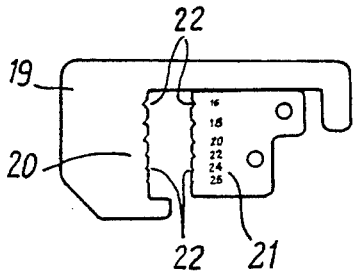
FIG. 2 is an elevational view of a stripping cutter of said device.
Figure 3:
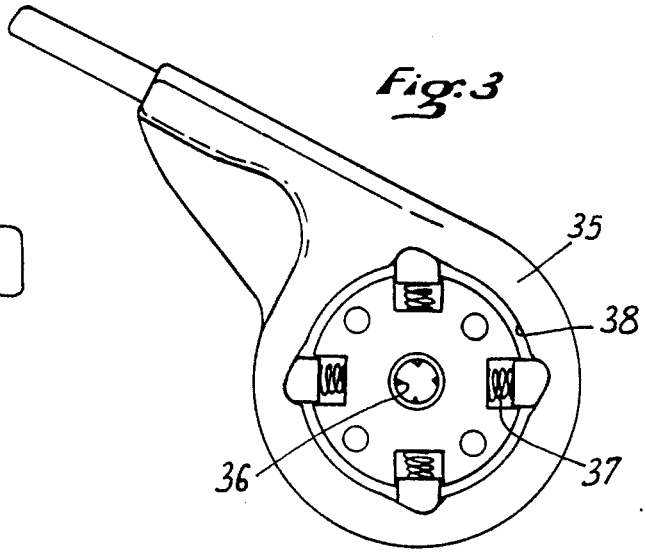
FIG. 3 is an elevational view of a contact setting or crimping head of said device.
Figure 4:
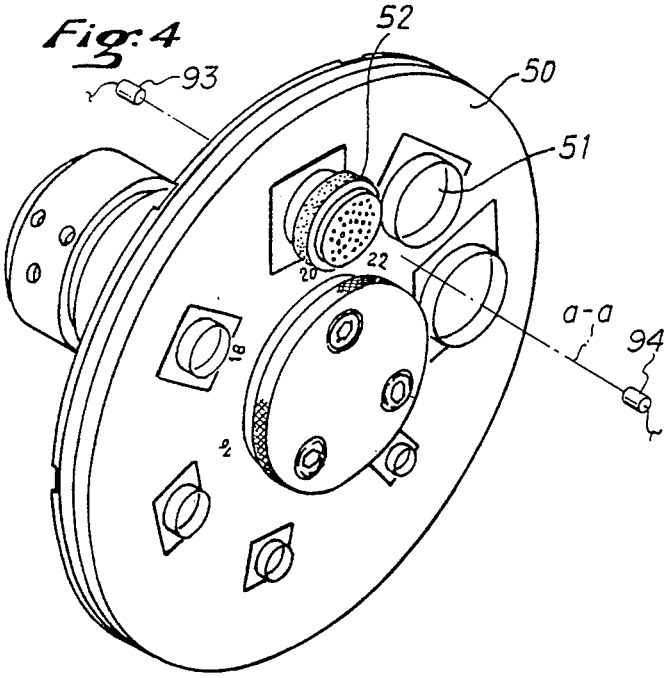
FIG. 4 is a perspective view of a connector box-carrying plate.
Figure 9:
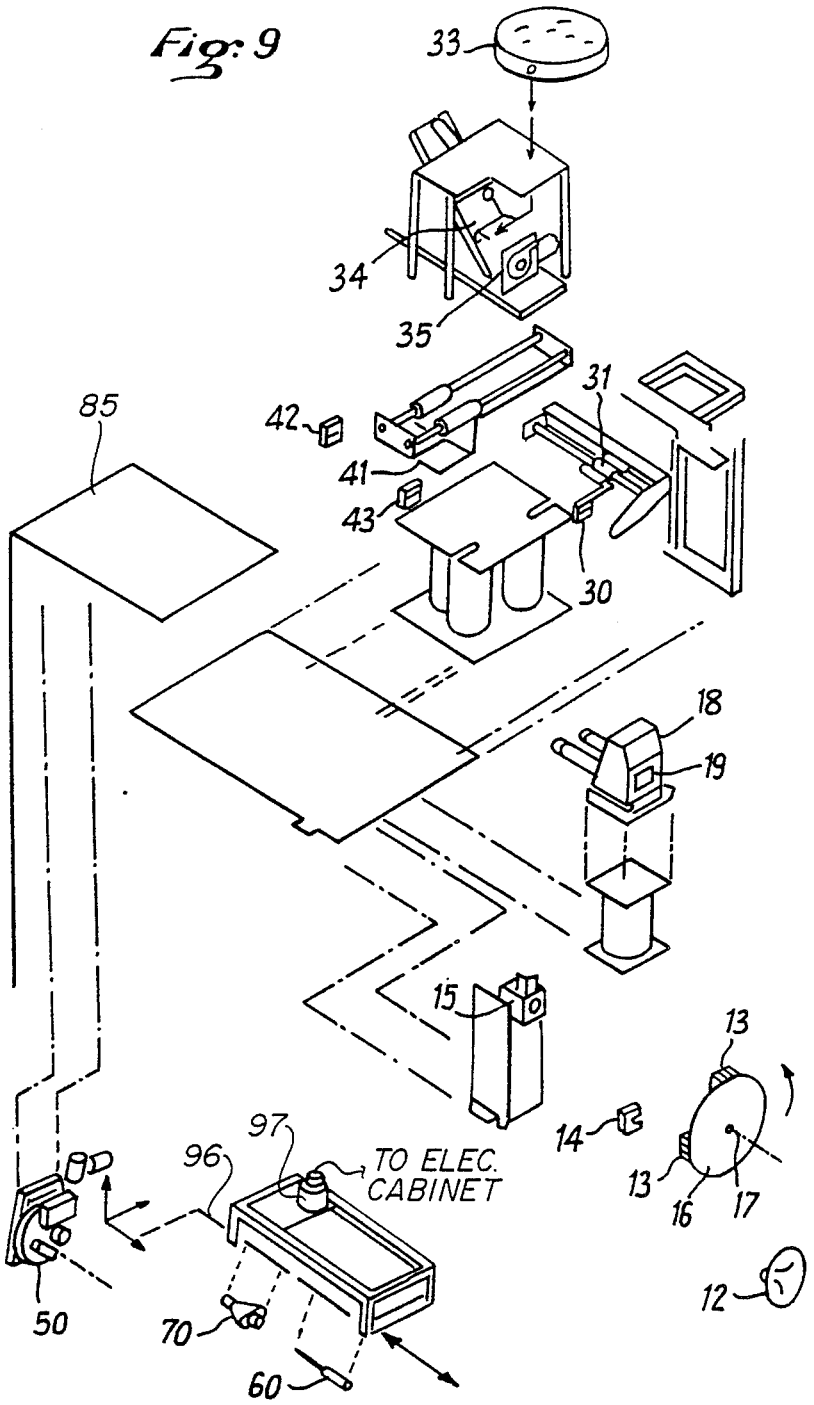

FIG. 7 gives diagrammatic views *7a–7d* of the head and nib in the different stages of insertion;

FIG. 8 is a sectional view, in the region of a cavity, of a contact placed in position in the connector, and FIG. 9 is an exploded diagrammatic view of the device of FIG. 1, showing the main components of the device.

Figure 5:
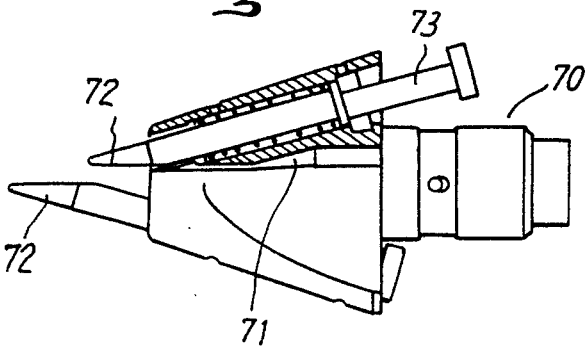
FIG. 5 is an elevational view, partly in section, of the insertion head of said device.
Figure 10:
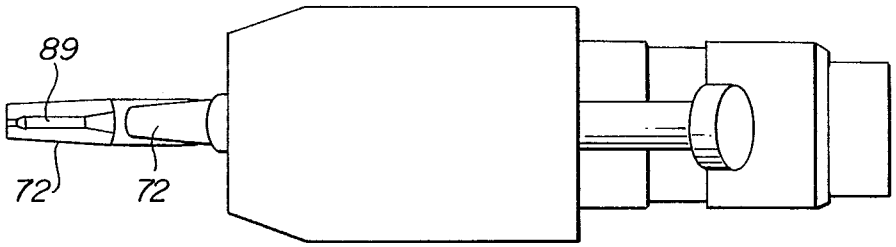

FIG. 10 is a top plan view of FIG. 5.

Figure 11:
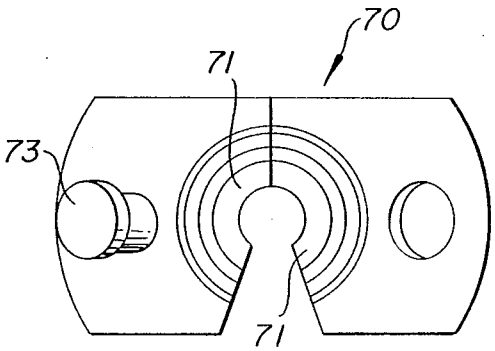

FIG. 11 is a right end view of FIG. 10.

Figure 6:
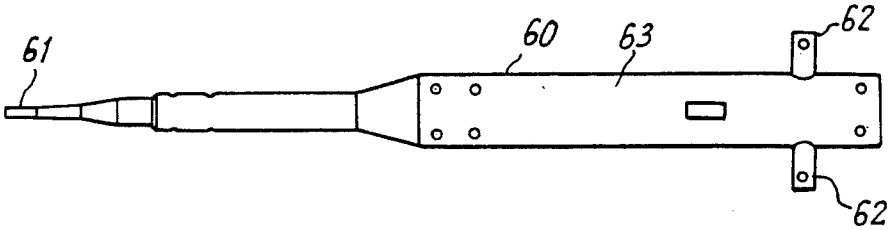
FIG. 6 is an elevational view of the insertion nib which is cooperative with said head.
Figure 12:
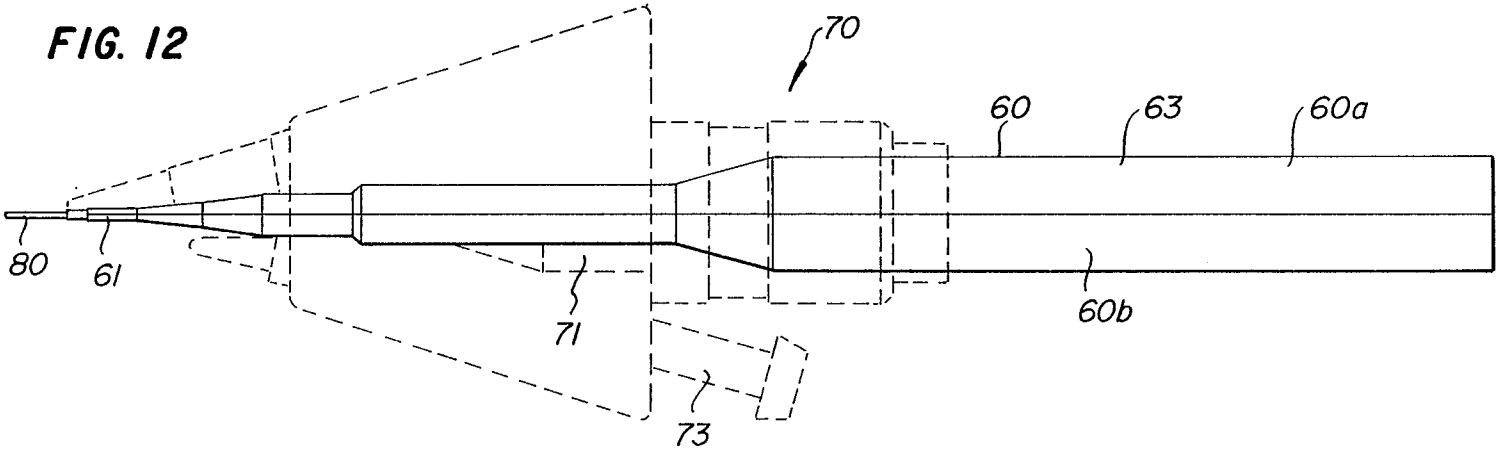

FIG. 12 illustrates the head of FIG. 5 in dotted lines and moved to a certain relationship relative to the nib of FIG. 6.

Figure 13:
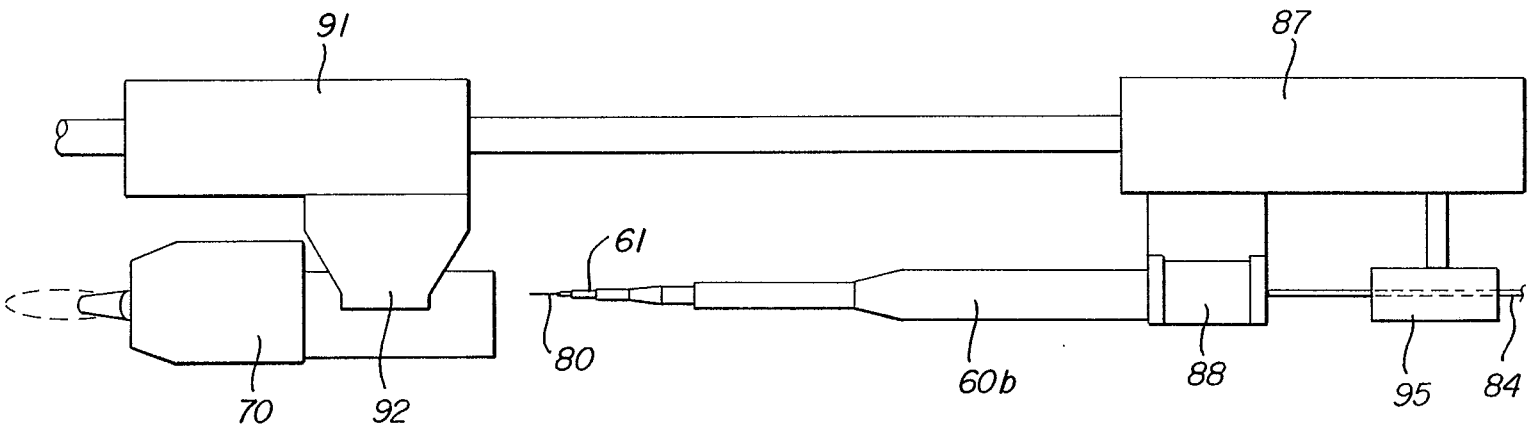

FIG. 13 illustrates the head and nib of FIGS. 5 and 6, respectively, relative to certain support structures of the device.

With reference to FIG. 1, it can be seen that the device comprises the device 1 proper and a number of accessory devices, namely an electronic cabinet 2, an operator station 3 with a seat and possibly a starting magazine 4 which may contain referenced sections of wire and a work machine 5 which may contain various accessories in which the section of wire must be inserted.

Disposed at the operator station are an alphanumeric data entry keyboard 6 and a display screen 7. Preferably, a computer monitor is associated with the alphanumeric keyboard 6.

The device 1 comprises the following stations connected by a path in heavy line illustrating diagrammatically the path of the front end of a section of wire, namely: an introduction station A, a stripping station B, a setting or crimping station C and an insertion station comprising in fact a station D for taking over the connector by a nib or quill and the insertion station proper E.

The introduction station A disposed in the front part of the device in the vicinity of the operator station 3, presents a funnel member 12 which facilitates the introduction of the end of the wire or cable to be set in position. Located behind the member 12 is a gripping device 13 capable of taking hold of the wire at a rather short distance from its end. The gripping device 13 is part of an assembly of four gripping devices 13 supported at equal angular distances apart by a barrel 16 which rotates about a horizontal axis 17. A wire sectioning device 14 is located behind the gripping device and in front of a device 15 for detecting the end of the wire or cable comprising a contact plate which acts as a stop and indicates the presence of the wire.

Rotating the barrel 16 through a quarter of a revolution brings the end of the wire held by the gripping device 13 which had gripped it, to the stripping station B. This station comprises, mounted on a suitable slide 18, a stripping device 19 having two cutter jaws 20, 21 which are moved in translation relative to each other and are provided with symmetrical semi-circular sets of cutting notches 22 adapted to the different diameters or gauges of wire. The slide 18 is movable toward and away from the end of the wire held by the gripping device 13, the jaws being separated in the course of the movement toward the end and moved closer together when moving away from said end for effecting the stripping of the wire.

Advantageously, a checking of the electrical continuity may be carried out with the usual contact elements at the stripping station to verify that the stripping has in fact been effected.

The device 19 may moreover be shifted vertically so as to bring the pair of notches corresponding to its diameter to the region of the wire end.

A new rotation through a quarter of a turn in the counter-clockwise direction brings the wire end to the setting or crimping station C. The station C comprises a gripping device 30 mounted on a slidable carriage 31 capable of shifting the wire end axially between the position determined by the gripping device 13 and the setting station C proper, the gripping device 13 providing a certain resistance to this transfer to oblige the wire to remain rectilinear between the spaced-apart gripping devices 30 and 13. This gripping device 30 takes hold of the wire in the region of the unstripped part of the wire and leaves the section and stripped end of the wire free.

The setting station C further comprises a vibrating bowl 33 acting as a reserve of contacts 80. This vibrating bowl feeds the contacts 80 one after the other to a selecting and presenting device 34 of conventional type which presents the contact 80 in the central passage of a setting or crimping head 35 provided with four punches 36 biased to a position away from the passage by conventional springs 37 which urge the actuating punch heads away from the central passage. The rotation of the peripheral part 38 of the head 35 causes the punches to be driven in by a camming effect, the extent of driving in being determined by the angle of rotation.

The central passage of the setting head 35 is judiciously aligned with the path of a sectioned and stripped end of wire determined by the movement of the gripping device 30 so that this end enters the socket 81 of the contact 80, after which the punches 36 set the socket 81 on the stripped wire end.

A setting check may be carried out while the socket 81 is blocked by the punches after the setting by attempting to move the gripping device 30 rearwardly away from the setting station C and noting that this movement is impossible.

A visual inspection of the quality of the setting may advantageously be carried out by a corresponding camera or any other display device projecting the images of the set contact 80 on the screen 7.

The transfer of the wire on which the contact has been set to the insertion station is effected horizontally in a direction perpendicular to the direction of the wire on which the contact has just been set. For this purpose, a carriage 41 which is horizontally and transversely movable relative to the direction of movement of the carriage 31 carries two spaced-apart gripping devices 42, 43, the gripping device 42 taking hold of the contact while the gripping device 43 takes hold of the wire or cable remote from the contact, the wire extending in a rectilinear manner between the gripping devices 42, 43.

When the wire provided with its contact 80 reaches, by the movement of the carriage 41, a position of alignment with the insertion station E, the wire may be taken up between the gripping devices 42 and 43 by the insertion means.

The insertion station E comprises a movable table 85 which is vertically movable in coordinates. Fixed on this table is a plate 50 provided with supports 51 for receiving connector boxes 52 in a perfectly indexed position, each support 51 being adapted to a particular type of connector. The table 85 which supports the plate may be shifted in the vertical plane so as to be capable of exactly aligning each cavity 53 of the connector with the rectilinear path travelled through by the contact in the insertion station E. This movment is effected in a conventional manner by step-by-step motors controlled by a microprocessor responding to orders from the principal microprocessor managing the inputs of the alphanumeric keyboard 6.

Owing to constructional and mounting tolerances, relatively large differences of position may appear from one connector to the other. The device according to the invention comprises for overcoming this drawback a geometrical analysis axis a—a parallel to the axis formed by the rectilinear insertion path and located at a precise distance from the latter. Located at the two ends of this analysis axis are two exactly aligned optical fibers 93 and 94, one emitting a light beam and the other receiving this beam. A third fibre takes into account the ambient light. The control means of the device according to the invention, which incorporates a microprocessor shifting the table so that a given cavity of the connector box mounted on the plate 50 comes to be presented onto the analysis axis. Normally, in the absence of tolerance, the corresponding cavity would be aligned with the emitting and receiving fibres. By successive programmed displacements, the device searches the signal of maximum amplitude which corresponds to the best position of the connector for this cavity. The operation is then repeated for a second given cavity and when these two data are entered, the connector is perfectly located in space.

The insertion station E comprises the insertion means including the insertion head, the nib or quill for the insertion proper, and a test gripping device whereby it is possible to check the locking of the contact in its cavity and a displacement force sensor associated with a motor controlled by means of the current by a specific microprocessor in order to control the insertion cycle as to speed, acceleration, displacement, torque and force.

The insertion nib 60 has a generally tubular shape and consists of two semi-sheels or semi-nibs **60*a*, 60*b* separated by an axial plane of symmetry. Each semi-nib has, in front of a part 63 forming a body, an end 61, the diameter of the tube formed by the union of the two semi-nibs not exceeding that of a contact flange 82, i.e. less than the diameter of the cavity 53. The semi-shells of the nib 60 are carried by a carriage 87 which is movable in a direction parallel to the insertion path, each shell being mounted and indexed by means 62 on a movable arm 88 carried by the carriage so that the symmetrical movements of these arms can, in one direction, move the two semi-nibs away from the rectilinear insertion path and, in the opposite direction, move the semi-nibs together up to a closing of the nib 60 centered on the insertion path, the ends 61 coming to surround the socket part 81 of the contact 80 located at the rear of the flange 82, the rest of the nib surrounding the wire or cable 84** part which follows on the contact.

The insertion head 70 is constituted by two elements or semi-heads of faired or bevelled shape which gives to the head 70, when the two elements are assembled, a conical appearance, as can be seen in FIG. 5. Each of the elements has a semi-recess 71 capable of receiving the body 63 of the nib whose end, and in particular the terminal part 61, emerges at the front end. In order to protect the front end of the nib and the connector, each insertion semi-head also includes a gripping device element 72 which is also faired or bevelled and provided with a suitable recess 89 receiving the end 61 of the nib and, beyond, a contact part 90 of contact 80 located in front of the contact flange 82 while however allowing to emerge in front of the two gripping device elements 72 to emerge at the front when they are united, the front end 83 of the contact. The gripping device elements 72 are moved between their advanced position and their withdrawn position releasing the nib by means of rods 73 in a direction which is inclined relative to the axis of the path and therefore of the axis of the nib, under the effect of suitable jacks. A separate carriage 91 carries the insertion head 70 through the medium of two supports 92 enabling the insertion semi-heads to be moved away from each other or to be united around the nib 60. This carriage will be coupled to that carriage 87 carrying the nib 60 when the wire to be inserted is in position.

The test gripping device is mounted on the nib-carrying carriage behind the nib and permits holding the wire for exerting a rearward pulling force for the contact clipped engagement test. It comprises a support against which comes to bear a movable jaw of the gripping device.

The device operates in the following manner:

The operator takes a cable or wire section from the wire section magazine and, after having identified it, enters the reference of the wire by means of the keyboard. This entry stored in memory by the electrical control means comprising a microprocessor, will cause the displacement of the movable table of the connector box-carrying plate 50 so as to present the cavity corresponding to this wire as a function of suitable software, in alignment with the insertion path when this wire reaches the insertion station E.

The operator then introduces the end of the wire in the funnel member 12 and the end of the wire abuts against the contact plate which indicates the presence of the wire. The actuation of this contact starts up one cycle of the device, each of the stations A to E carrying out all of the operations pertaining thereto during this cycle. As concerns the station A, the starting up of the cycle causes the closing of the transporting gripping device 13, then the sectioning of the end of the wire and, after a pause enabling the other stations to carry out their operations, the barrel 16 is driven in rotation in the counter-clockwise direction through a quarter of a turn and the sectioned end of the wire is then presented to the stripping station B. A new free gripping device is then available at the station A in front of the sectioning device.

At the station B, the cycle causes the stripping of the end of a wire section which is present. The entry of the identification of the wire has also caused, by means of the software, the choice of a notch size of the stripping cutter and the device containing the cutters is then, if need be, shifted vertically so as to bring the notch at the suitable horizontal level. As the sectioned wire end is disposed at a perfectly precise and fixed position, the length of the stripping will be determined by the advance travel of the stripping device 19 toward and along the wire. A stop, determined by a directly graduated manual micrometer screw, may be employed for defining the stripping length.

At the end of the advance of the stripping device, which determines the length of the stripping, the stripping cutters are actuated and their notches enter the insulation surrounding the conductive core of the wire. The device 19 then starts to move rearwardly and causes the stripping. When it reaches the position of rest, the cutters are opened and a jet of air from a nozzle cleans the cutters and discharges the scrap.

Owing to the large pulling force exerted on the wire there may be advantageously provided at the stripping station means for reinforcing the gripping device 13, for example by the action of jacks which exert an additional gripping force.

A new rotation through a quarter of a turn in the counter-clockwise direction brings the wire end to the setting station. In this region, the gripping device 30 comes to take over the wire section end in the region of the beginning of the unstripped part of the wire, then the gripping device 30 pulls the wire toward the setting tool, the gripping device 13 then exerting merely a braking force to maintain the wire perfectly rectilinear during its advance. During this time, a contact from the vibrating bowl has been placed in position in alignment with the central passage of the setting head 35 with the contact socket 81 aligned with the path of the wire end, after which the setting head 35 is advanced so as to surround the contact socket. The software controls, as a function of the identification of the wire, the extent of rotation of the peripheral part 38 of the setting head and, consequently, the magnitude of the camming effect produced on the punches 36, for example by the effect of a stop at the end of the rotation, and the setting is effected. At the end of the setting, the setting head moves rearwardly away from the set contact, the operator then being able to see the contact and the wire which are displayed on the inspection screen. After this, the gripping device 30 opens, while the gripping device 42 takes hold of the contact by its front pin and the gripping device 43 takes hold of a part of the wire remote from the contact, the wire extending in a rectilinear manner between the gripping device 42 and 43. The carriage 41 which came from a median position of rest to present the gripping device 42 and 43 is then subjected to a movment of translation toward the insertion station E and aligns the wire along the insertion path.

In the insertion station E, the two semi-nibs **60*a*, 60*b* which were separated from each other come to be disposed on each side of the wire 84 and the rear end of the contact socket 81 at the rear of the flange 82 and reconstitute the nib 60 between the gripping devices 42 and 43. The latter are then opened and the carriage 41** is returned to the median standby position.

During this time, the positioning table 85 positions the considered cavity of the connector, as a function of the instructions of the software, in the insertion path.

The nib-carrying carriage 87 then advances toward the plate 50 carrying the connector box. In its advance, this carriage 87 encounters and drives the movable carriage 91 carrying the insertion head 70. At this moment, the gripping devices 72 are actuated and maintain the contact of which only the front end 83 of the pin projects forwardly, for example by four mm. as shown in the diagram of FIG. 7*a*. The two nib and head carriages then advance together until the contact has penetrated a short distance (for example 1 to 2 mm) inside the connector cavity 53. In this movement, the contact 80 is rigidly maintained and only its front end projects beyond the gripping device 72. The faired or bevelled shape of the insertion head, with its gripping device 72, gradually moves apart those of the already-inserted wires which are present and permits proceeding to the start of the insertion without hindrance and without deterioration of the wires of the other already-inserted contacts.

When the front end of the contact has entered the connector cavity 53 as shown in FIG. 7*b*, the carriage 91 of the insertion head 70 stops and the gripping devices 72 open and release the contact. At this moment, the carriage 87 carrying the nib 60 advances to the point of completely inserting the connector in the position shown in FIG. 7*c*. This position is detected by the magnitude of the torque required beyond a certain threshold without movement.

The test gripping device 95 then grips the wire 84 and the nib carriage 87 is subjected to a reverse movement and pulls on the wire retained by the contact clipped into its cavity. Beyond a certain threshold, the pull ceases and the test gripping device releases the wire and thereby ascertains that the insertion has been suitably effected. The nib carriage 87 moves rearwardly until the position corresponding to the advanced position of the insertion head carriage 91 is reached and the insertion carriage is then once again attached to the nib carriage.

The assembly of the two carriages 87, 91 moves rearwardly to the standby position of the insertion head-carrying carriage 91 in which the latter is detached from the nib carrying carriage 87 which alone travels rearwardly to its position of rest. The nib and the test gripping device open and release the wire and the insertion cycle is terminated.

Advantageously, the movements are measured from an origin by an incremental encoder fixed on the driving shaft 96 of the nib-carrying carriage. A force sensor placed on the driving belt measures the forces exerted on the nib. The driving motor 95 is a current-controlled DC motor with low inertia, which permits defining and controlling at every instant its acceleration, speed and torque. During this cycle, the insertion forces and the wrenching forces are therefore checked and any deviation from the thresholds stored in the memory stopping the cycle.

The degree of automatization of the device according to the invention may vary. Indeed, instead of using an operator, the station A could also be fed by an automatic device with wire sections coming from a section preparation station, it being possible to substitute automatic means for the entry of the identification of the wire, for example by an optical reading, for the wire identification entered by means of an alphanumeric keyboard.

For connectors which would employ several types and sizes of pins, there could also be provided several vibrating bowls and means for bringing onto the axis of the passage of the setting head a contact of given type in accordance with the identity entered for the corresponding wire.

Further, as concerns the stripping station, the software may vertically shift, in accordance with the identification of the wire, the stripping cutter jaws in order to present the notch corresponding to the considered wire diameter.

I claim:

1. A device for inserting contacts, each contact having a front end and a rear end and being provided with a flexible conductor or cable extending out of the rear end, in a desired one of a plurality of cavities of a connector box, which device comprises:

a connector box support;

a support moving means for producing a relative movement between the connector box support and a path along which the contact is moved to said connector box so as to present the desired cavity of the connector box in said path; and an insertion means for inserting the contact along the path into the connector box, said insertion means comprising:

(a) an insertion head which is openable for receiving a contact and closable around the contact, a forward end of the head adjacent to the front end of the contact and oriented toward the connector box being beveled for the purpose of gradually spreading apart during the movement of the head toward the connector box any cables and contacts which may have already been mounted to the connector box, (b) a head closing means for opening and closing said insertion head, (c) a head moving means for moving said insertion head between a withdrawn position for receiving the contact and an advanced position close to the cavity located in the path, and (d) a final insertion means for shifting the contact along and end portion of said path after said head closing means opens between a position of the contact corresponding to said advanced position of the insertion head and a position corresponding to the end of the insertion of the contact in the cavity.

2. A device according to claim 1, wherein, when the insertion head is closed around the contact by said head closing means, a front end portion of the contact emerges from a front part of the insertion head, the advanced position of the insertion head being such that said contact end portion partly enters the cavity.

3. A device according to claim 2, wherein, after the insertion head is moved to the advanced position and opens, the final insertion means comprises a nib having an end of small diameter and a nib moving means for pushing the contact with the nib such that the nib enters the cavity with the contact.

4. A device according to claim 1, wherein the final insertion means drive the flexible cable or wire disposed at the rear end of the contact, a guide channel in said insertion means guiding and containing the cable in a position close to a rectilinear position so as to constrain the cable to push the contact forwardly in the cavity.

5. A device according to claim 1, wherein the final insertion means comprises a nib separable into two semi-nibs and a nib closing means for opening and closing said semi-nibs around an element selected from at least one of the following: the rear end of the contact an end of the cable adjacent said rear end of said contact.

6. A device according to claim 1, comprising driving control means for controlling said head moving means such that the insertion means is moved first of all, in starting in an initial position in which the insertion head takes over the contact, at a high speed, then, when the vicinity of said advanced position of the insertion head close to the cavity has been reached, at a low speed; said driving control means including a detecting means for stopping the movement of the insertion head if a resistance to movement encountered by said head moving means exceeds a threshold value, after which the final insertion means is moved also by said head moving means first of all at a high speed, and then, when a position close to the position corresponding to the end of the insertion has been reached at a low speed, said driving control means also including a detection means for immediately stopping the movement of the final insertion means when the contact has reached its position corresponding to the end of the insertion.

7. A device according to claim 1, wherein the final insertion means comprises a test gripping device which, when the contact has been definitively inserted, grips the cable and exerts a rearward pull thereon.

8. A device according to claim 1, wherein the connector box is mounted on a table movable in coordinates and an analysis axis parallel to the direction of said insertion path and located at a given distance from said path is provided, and further including an optical means for determining the exact positioning of the cavities of the connector box defining the position of the connector box in space.

9. A device according to claim 1, comprising cable setting, cable stripping, and cable end sectioning stations for an end of the cable.

10. A device according to claim 5, wherein the insertion nib comprises two semi-shells having a part forming a body and an end of small diameter less than the diameter of the cavity, said semi-shells being carried by movable arms symmetrically located on each side of the insertion path and carried by a nib carriage.

11. A device according to claim 1, comprising means for the entry of an identification of a cable section whose contact is to be inserted in a given cavity of the connector box for controlling the insertion device.

12. A device according to claim 5, comprising a carriage carrying the nib and a test gripping device mounted on the nib-carrying carriage which selectively grips the cable protruding from a rear of the nib.

13. A device according to claim 1, wherein the insertion means further comprises an insertion nib, a nib carriage on which is mounted said insertion nib, a head carriage on which is mounted the insertion head, and a carriage mounting means for mounting said nib carriage and said head carriage for movement such that the nib carriage in its movement toward the connector box initially drives the head carriage and subsequently said head carriage is disengaged from the nib head carriage in the final insertion movement.

14. A device according to claim 9, wherein said cable stripping station includes a slide, a stripping device mounted on said slide having two cutter jaws provided with a symmetrical set of semi-circular cutting notches adapted to different wire diameters, a jaw moving means for moving said jaws toward and away from the cable end, and a stripper moving means for moving said slide toward and away from the cable end.

15. A device according to claim 14, wherein said stripping device is adjustable in a direction for presenting the respective set of notches for the stripping of the cable in accordance with a predetermined wire diameter of the cable.

16. A device according to claim 9, wherein said cable setting station includes a setting head, a slidable carriage, a gripping device mounted on the slidable carriage which grips the cable, a slidable carriage shifting means for shifting the slidable carriage and hence the cable end axially toward the setting head, and means for maintaining the cable in a rectilinear shape.

17. A device according to claim 16, wherein the setting head of the setting station comprises a central passage in which the contact is received, and wherein the setting station comprises a setting moving means for axially moving the central passage of said setting head away from the position where the contact is aligned with the central passage of said setting head.

18. A device according to claim 16, comprising a transfer means for transferring the contact and attached cable between the setting station and the insertion station, said transfer means including a carriage provided with two spaced-apart gripping devices, one of the spaced-apart gripping devices seizing the contact and the other of the spaced-apart gripping devices seizing the cable in a remote position.

19. A device according to claim 1, wherein the final insertion means includes a nib having a front end; and wherein the insertion head comprises two bevelled semi-heads, each of the semi-heads defining a semi-recess capable of receiving the nib and protecting the front end of the nib, each insertion semi-head having a gripping device element which is also bevelled and provided with a suitable recess for receiving a nib front end and a contact part.

20. A device according to claim 19, comprising inclined rods for moving the gripping device elements between an advanced position and withdrawn position of the gripping device elements for releasing the nib.

21. A device according to claim 9, comprising a cable insertion station including a barrel, a gripping device mounted on the barrel, a wire sectioning device and a stop contact.

* * * * *